US006142074A

United States Patent [19]

Flament

[11] Patent Number: 6,142,074

[45] Date of Patent: Nov. 7, 2000

[54] WEB HOLDING DEVICE IN A ROTARY PRINTING PRESS

[75] Inventor: Daniel Flament, Igny, France

[73] Assignee: Heidelberger Druckmaschinen Aktiengesellschaft, Heidelberg, Germany

[21] Appl. No.: 09/048,566

[22] Filed: Mar. 26, 1998

[30] Foreign Application Priority Data

Mar. 26, 1997 [FR] France ..... 97 03693

[51] Int. Cl.[7] ..... B41F 5/04

[52] U.S. Cl. ..... 101/219; 226/11

[58] Field of Search ..... 101/219, 224, 101/225, 226, 227, 228, 232, 484; 226/11, 45

[56] References Cited

U.S. PATENT DOCUMENTS

| | | | |
|---|---|---|---|
| 3,281,043 | 10/1966 | Plumb | 226/195 |
| 4,019,435 | 4/1977 | Davis | 101/232 |
| 4,523,522 | 6/1985 | Fischer | 101/219 |
| 4,538,517 | 9/1985 | Michalik et al. | 101/219 |
| 4,887,532 | 12/1989 | Kotterer | 101/225 |
| 5,163,371 | 11/1992 | Kotterer et al. | 101/484 |
| 5,443,008 | 8/1995 | Pavliny et al. | 101/219 |
| 5,511,712 | 4/1996 | Holm et al. | 101/228 |
| 5,615,610 | 4/1997 | Prohaska | 101/219 |
| 5,873,602 | 2/1999 | Hernandez | 281/44 |

FOREIGN PATENT DOCUMENTS 752212 7/1956 United Kingdom .

*Primary Examiner*—John S. Hilten
*Assistant Examiner*—Amanda B. Sandusky
*Attorney, Agent, or Firm*—Herbert L. Lerner; Laurence A. Greenberg; Werner H. Stemer

[57] ABSTRACT

A holding device for a web of material in a rotary printing press having rollers over which the web of material is guidable, includes a temporarily activatable retainer for retarding motion of the web of material counter to motion of the web in an original travel direction thereof, the retainer being operatively associated with each of the rollers over which the web of material is guidable.

12 Claims, 3 Drawing Sheets

WEB HOLDING DEVICE IN A ROTARY PRINTING PRESS

BACKGROUND OF THE INVENTION

Field of the Invention

The invention relates to a device for holding a web of material in a rotary printing press, more particularly, having rollers over which the web is guidable, the holding device including at least one pressing element for varying web tension, and being disposed in a superstructure of the rotary printing press, especially an angle-bar or turnerbar superstructure.

The published German Patent Document G 91 09 313.9 U1 is concerned with a device for guiding a moving web. With the aid of guide elements provided with a blower or blast slot and extending over the width of the web and in the web travel direction, air is blown substantially parallel to the web travel direction. It is intended thereby to span great distances between two guide elements, for example, if a paper web which is yet moist is to be guided in a paper processing machine between a press section and a dryer section.

The published German Patent Document DE 44 08 713 A1 is concerned with a method and a device for guiding a web of material. In the embodiment described therein, which involves guiding the web in a paper-processing machine, a strip of the paper web is brought behind the press section of the paper-processing machine. Thereat, an air stream directed approximately tangentially to the guide roller from a blast nozzle device assures the transport of the paper web to a downstream unit.

The published German Patent Document DE 28 08 840 A1 discloses a pneumatically actuatable pressing roller introducible for avoiding or reducing slip between the paper web and driven rollers, particularly, in web-fed rotary printing presses. The intent is to achieve especially sensitive variation or adaptation of the necessary contact-pressure force, so that the web tension can be varied through the slip. The pressing roller should, moreover, have a low structural height. This is attained primarily by disposing a diaphragm in a first, shallow housing supported on the printing-press frame; in accordance with an adjustable air pressure in the housing, the diaphragm acts via a diaphragm plate on the bearings of the pressing roller and, accordingly, on the pressing roller itself. Pressing rollers of this type are used at the web infeed or at the driven rollers of the cooling section.

In material-processing rotary printing presses, meter-high angle-bar or turnerbar superstructures are often used, in order to collate the products, in the various configurations thereof, which can be produced with a rotary printing press, and then fold them longitudinally and/or transversely, depending upon the type of product. If an extremely undesirable break or tear in a web of material should occur in these superstructures, as a rule, the portion of the web yet remaining in the printing press ahead of or upstream from the break or tear can still be processed and can remain in the angle-bar superstructure in the prescribed web path, without requiring the web to be threaded in again thereat. Threading the web of material in again is extremely time-consuming, because the web to be threaded in again must be re-introduced into the original web path thereof by two persons, angle or turner bar by angle or turner bar, or guide roller by guide roller, in accordance with the prescribed product configuration. This takes time, requires a stoppage of production, and is therefore very expensive.

SUMMARY OF THE INVENTION

It is accordingly an object of the invention to provide a web holding device in a rotary printing press and, more particularly, such a web holding device associatable with any freely rotating web guide roller in the rotary printing press, which avoids the foregoing disadvantages of the prior art.

With the foregoing and other objects in view, there is provided, in accordance with the invention, a holding device for a web of material in a rotary printing press having rollers over which the web of material is guidable, comprising a temporarily activatable retainer for retarding motion of the web of material counter to motion of the web in an original travel direction thereof, said retainer being operatively associated with each of the rollers over which the web of material is guidable.

In accordance with another feature of the invention, the retainer includes at least one flexible retaining element engageable with the rollers over which the web of material is guidable.

In accordance with a further feature of the invention, the retaining element extends over the width of the respective rollers.

In accordance with an added feature of the invention, the retaining element has flexible bristles.

In accordance with an additional feature of the invention, the retainer includes a plurality of individual flexible retaining elements engageable with each of the rollers over which the web of material is guidable, the retaining elements being distributed over the width of the respective roller.

In accordance with yet another feature of the invention, the web of material is formed of a plurality of individual web ribbons, and a respective retaining element is assigned to each of the ribbons of the web.

In accordance with yet a further feature of the invention, the holding device includes a device for selectively moving the retainers in and out of an active position thereof.

In accordance with an alternative feature of the invention, the selective moving device is a respective adjusting cylinder for selectively disposing the retainers in and out of the active position thereof.

In accordance with another alternative feature of the invention, the selective moving device is an electromotive device.

In accordance with a further alternative feature of the invention, the selective moving device is an electromagnetic device.

In accordance with yet an added feature of the invention, the holding device includes a device for selectively moving the retainers in and out of an active position thereof.

In accordance with a concomitant aspect of the invention, there is provided, in a rotary printing press having an angle-bar superstructure, the improvement comprising a plurality of holding devices mounted in the angle-bar superstructure for retarding movement of webs of material or ribbons thereof counter to an original travel direction thereof.

An advantage derived from the embodiment according to the invention is that if a web breaks for whatever reason, the part of the web located ahead or upstream of the location at which the break occurs can be held in the superstructure by the holding devices or retainers, thereby avoiding any necessity for rethreading the web in this section back around the many web guide rollers present therein. Moreover, because the retaining element cooperates with a deflection roller, which is located high up in the superstructure, the web of material can be prevented from dropping of its own weight through the galleries and stories of the superstructure. In addition, because threading of the web of material in again is then performed only partly in the angle-bar section, a faster restarting of the rotation can be achieved.

In further features of the concept upon which the invention is based, the holding device includes a flexible retaining element which is positionable into engagement with the rollers guiding the web of material. Due to the intermediary of the flexible retaining elements, firm retention of the web of material is possible without scratching the surfaces thereof or harming them in any other manner. The retaining element may be formed so as to extend over the entire width or breadth of the respective roller. In this embodiment, an actuation unit, such as an electric motor or a pneumatic cylinder, suffices to prevent the web length or web length strips or ribbons following or downstream of the location at which the break has occurred from dropping out of the superstructure, by positioning the retaining element against the deflection roller or so that it is in engagement therewith. If the retaining element is equipped with flexibly resilient, yielding bristles, scratching can be avoided when positioning the retaining element, because the bristles are laterally deflectable to a given extent and deflect accordingly during this positioning.

On the other hand, retaining elements can also be realized of which a plurality are mutually disposed adjacent one another and can act upon individual web strips or ribbons which have been previously slit lengthwise. In addition to an electromotive drive for the retaining elements, pneumatic or electromagnetic actuation thereof may also be contemplated. Mechanical positioning of the retaining elements into engagement with a deflection roller in the superstructure if a web break should occur is also possible.

Other features which are considered as characteristic for the invention are set forth in the appended claims.

Although the invention is illustrated and described herein as embodied in a web holding device in a rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
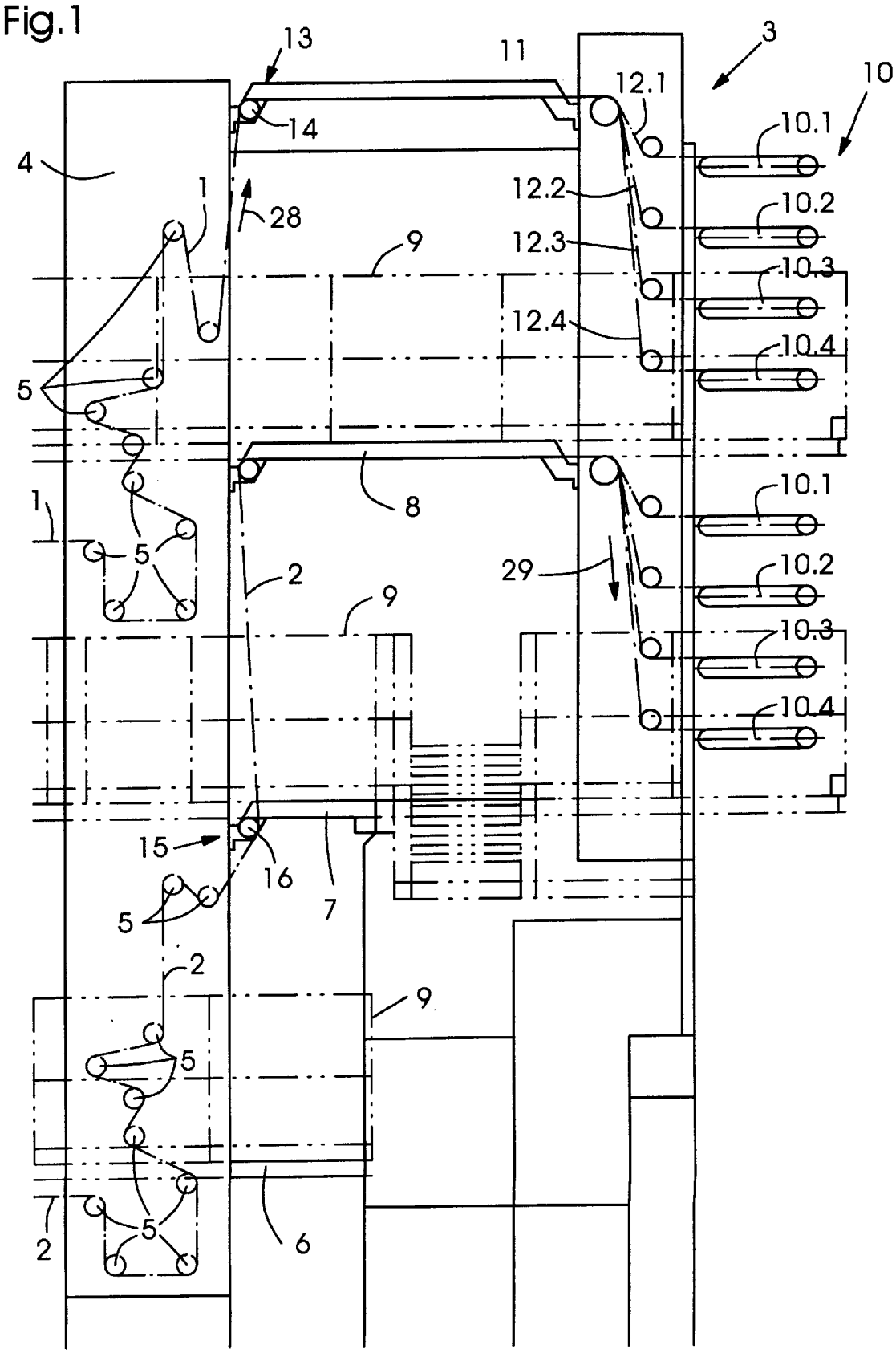
FIG. 1 is a fragmentary, diagrammatic side elevational view of a web-fed rotary printing press, showing a three-story high superstructure with an angle-bar or turnerbar section.

Referring now to the drawings and, first, particularly to FIG. 1 thereof, there is shown therein an exemplary superstructure 3 of a rotary printing press having side walls 4, only one of which is shown in the figure. A multiplicity of rollers 5 are supported in the side wall 4, and an upper web 1 and a lower web 2 of printing material are guided thereover. The upper and lower webs 1 and 2, respectively, may be made up of several web strips or ribbons, which have previously been imprinted on one or both sides in non-illustrated printing units. The webs 1 and 2 may, however, also be formed as wide, single-layer webs which are divisible into individual, parallel web strips or ribbons in longitudinal cutting devices or web slitters 11 in the superstructure 3.

The illustrated superstructure 3 is formed of several galleries. Both a first gallery 6 located above an infeed or entry region of the lower web 2 into the superstructure 3, and a second gallery 7 located below an infeed or entrance of the upper web 1 are secured by a respective railing 9. A third gallery 8, which extends to the inside of an angle-bar or turnerbar section 10 of the superstructure 3, is likewise guarded by a railing 9. Holding devices 13 or 15 according to the invention, which are positionable temporarily against deflection rollers 14 or 16, are provided at the deflection rollers 14 and 16, respectively, at a location at which the upper and lower webs of material 1 and 2, respectively, have already moved past the multiplicity of web guide rollers 5. It is readily apparent that if the upper or lower web of material 1 or 2 should break, for whatever reason, for example, in the angle-bar or turnerbar section 10 of the superstructure 3, then positioning the holding devices 13 and 15, respectively, against the surfaces of the affected deflection rollers 14 and 16 prevents the respective web 1, 2 remaining in the superstructure 3 from unwinding. If either or both of the upper and lower webs 1 and 2, respectively, were to slip out of a respective web path 28, 29 thereof in the superstructure 3, a tedious, time-consuming manual rethreading of the respective web 1, 2, would be required; wrapping the individual webs or strips or ribbons of webs of material around the multiplicity of rollers 5 would be very time-consuming.

The upper and the lower webs 1 and 2, respectively, can be cut or slit into individual web strips or ribbons 12.1 through 12.4, for example, lengthwise, by web slitters 11. Before the infeed or entrance of the respective web 1, 2 into the angle-bar or turnerbar section 10, conventional web slitters 11, which need not be shown or described in detail can be provided thereat. The individual web strips or ribbons 12.1 through 12.4 are turned at corresponding angle-bars or turnerbars 10.1 through 10.4 of the angle-bar or turnerbar section 10, depending upon production requirements, and are then fed to a folding apparatus for folding and, from there, to further processing equipment.

Figure 2:
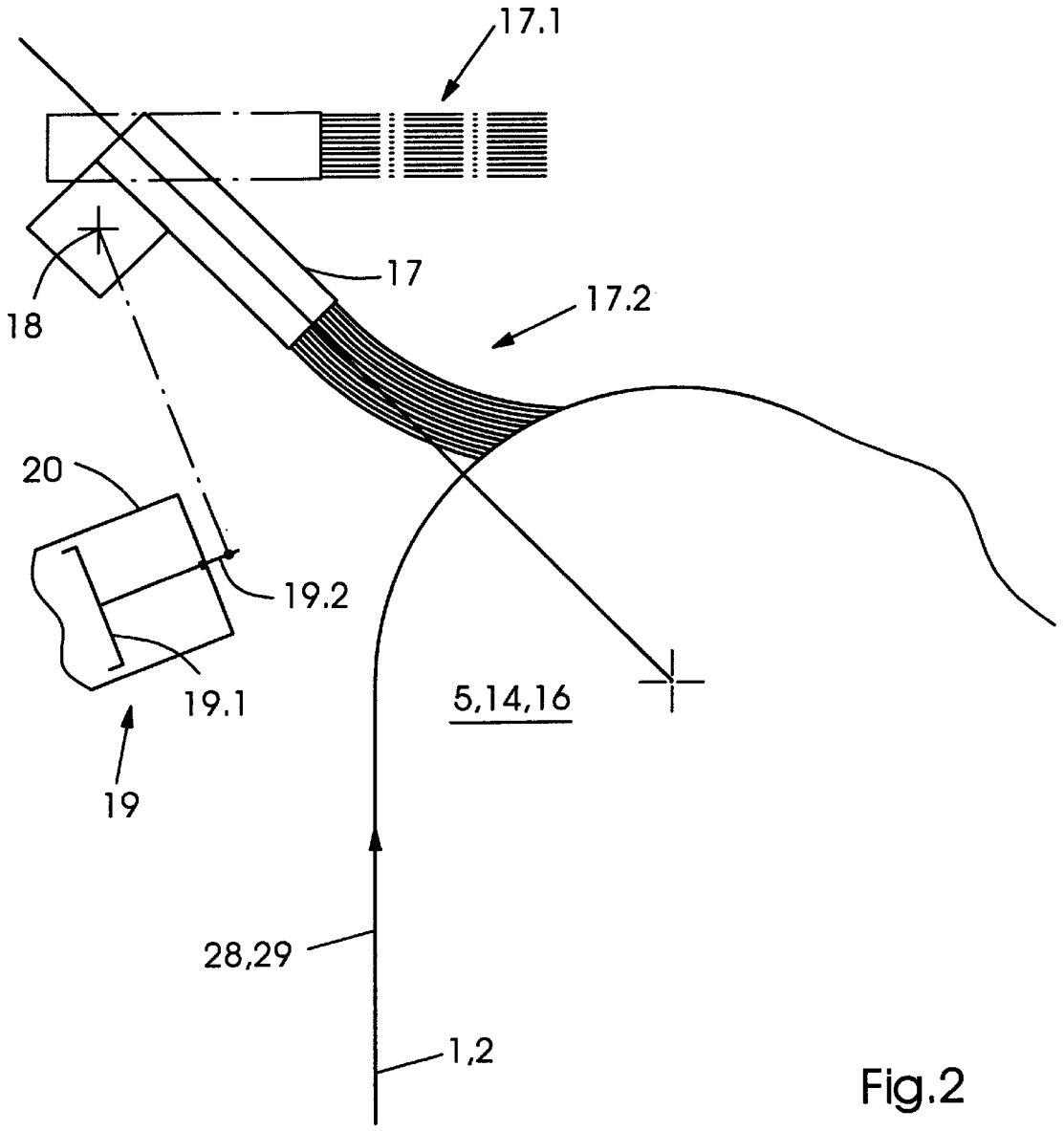
FIG. 2 is a greatly enlarged fragmentary view of FIG. 1 showing, in a diagrammatic basic sketch, a web-guiding roller of the printing press and a retaining element of a web holding device according to the invention.

FIG. 2 shows a diagrammatic basic sketch of a holding device 13 according to the invention, which can be associated with a deflection roller 14, for example.

In the event a break or tear occurs in the upper and lower webs 1 and 2, respectively, the web tension downstream of the deflection roller 5, 14 or 16 changes abruptly, as indicated by the wave-like motion of the web 1, 2 in FIG. 2. By its own weight, the webs 1 and 2, respectively, have a tendency to move counter to the original web travel direction 28, 29 and thus to unwind out of the superstructure 3. If an abrupt decrease in web tension should occur, flexible bristles of a retaining element 17 move from a position 17.1 into a position 17.2 wherein they are in engagement with the surface of a deflection roller 5, 14 or 16 guiding the web 1, 2 and, due to which, movement of the web of material 1, 2 counter to the original web travel direction 28, 29 is inhibited or retarded. The web 1, 2 wrapped around a multiplicity of rollers 5 in the superstructure 3 remains in the superstructure 3 and need not be tediously threaded back in again when rotation resumes. The positioning of the retaining element 17 against the surface of the deflection roller 5, 14, 16 is effected by a movement of the retaining element 17 about a pivot shaft 18 from a position 17.1 to a postion 17.2. This can be performed by a pneumatically actuatable adjusting cylinder 20, for example. Instead of an adjusting cylinder 20, an electric motor or an electromagnet, for example, may be used for the same purpose. A piston 19.1 and a piston rod 19.2 of the adjusting cylinder 20 are connected to the pivot shaft 18 via a coupling member and moves the shaft 18 about a pivot point thereof, causing the retaining element 17 to be positioned against the respective surfaces of the rollers 5, 14, 16 and moved away therefrom again, respectively.

Figure 3:
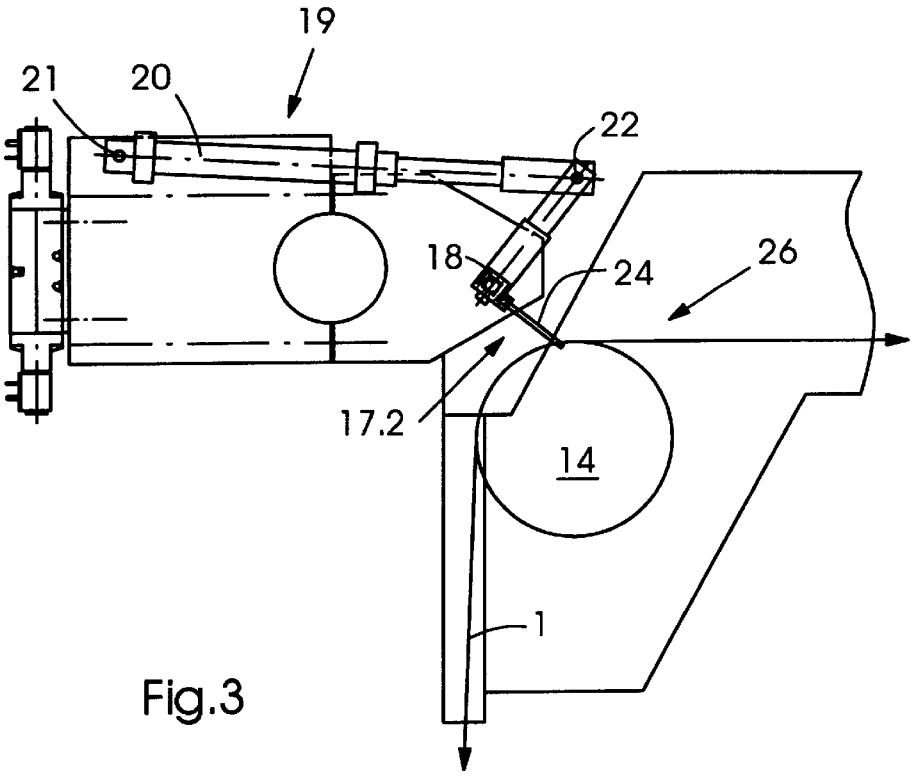
FIG. 3 is a side elevational view of a retaining element of a web holding device which has been actuated into an active position by an adjusting cylinder having a piston operatively connected thereto.

In FIG. 3, there is shown a web retaining element 24 according to the invention located at a deflection roller 14 which causes a deflection in the web 1, 2 of 90°. The retaining element 24, including flexible bristles, is shown in a position at 17.2 wherein it is in engagement with the surface of the deflection roller 14. The web 1, as it follows the web path 26 thereof, is prevented from unwinding out of the superstructure 3 counter to the original web travel direction 28, 29 thereof by a clamping action exerted by the retaining element 24 on the deflection roller 14. The motion of the retaining element 24 shown in FIG. 3 about the pivot shaft 8 is effected by an actuating device 19, which in this case is the adjusting cylinder 20 mounted on an abutment or support 21. The piston 19.1 and the piston rod 19.2 of the actuating cylinder 20 are connected to an articulation or link 22 by a coupling member, which pivots the retaining element 24 about the shaft 18 into the illustrated position 17.2 or into the aforementioned inactive position 17.1.

Figure 4:
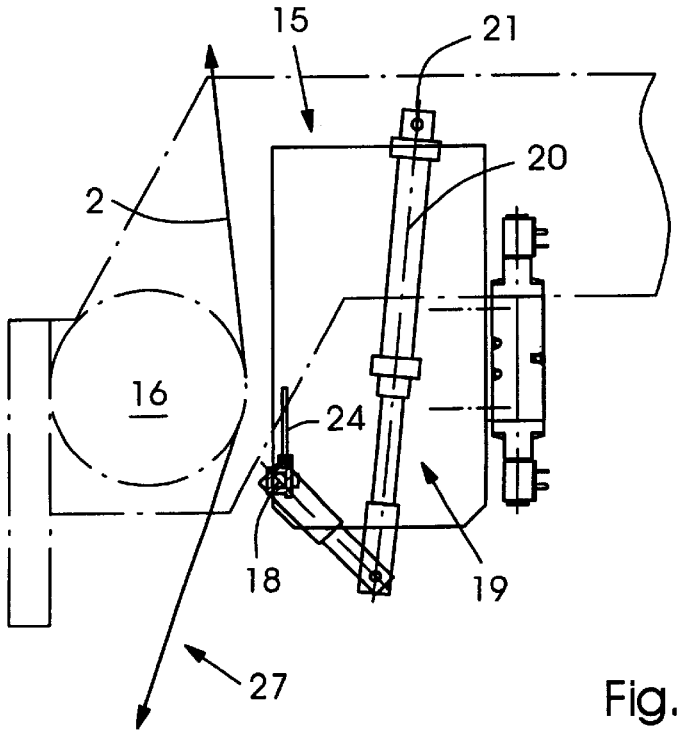
FIG. 4 is a side elevational view at a different location from that of FIG. 3 of an element of a web holding device which has been actuated by an adjusting cylinder into an inactive position.

FIG. 4 shows a holding device 15 according to the invention which, in FIG. 1, is provided below the second gallery 7 and causes a deflection of the lower web 2 of only 30° to 45°. After the lower web 2 has been fed into or enters the superstructure 3, it has already passed many rollers 5, as shown in FIG. 1, before it enters or runs into the angle-bar or turnerbar section 10 of the superstructure 3. At a location before the lower web 2, below the third gallery 8, runs into or enters the angle-bar or turnerbar section 10, a lower holding device 15 is provided, so that if a web breaks, with an accompanying abrupt drop in web tension, the web 2 is prevented from snapping back counter to the original web travel direction 29. The lower holding device 15 includes the actuation unit 19 having the adjusting cylinder 20 mounted on an abutment or support 21. The adjusting cylinder 20 moves a coupling member which, in turn, moves the retaining element 24 about the pivot shaft 18 thereof. Consequently, the retaining element 24 is positionable into engagement with the surface of the deflection roller 16 and can keep the web 2 wrapped around the roller 5 (note FIG. 1) in accordance with the prescribed web path 27, without having to wind the web 2 back around the roller 5.

Through the intermediary of the holding devices 13 and 15 of the invention, the web 1, 2 can be retained in the superstructure 3 between a non-illustrated cooling roller group and the lengthwise slitting devices 11 in the event of an emergency stop. Not until there is a continuous web speed can the holding devices 13 and 15, which are actuatable by remote control, be moved away again from the deflection rollers 5, 14, 16 of a respective web of material or strips or ribbons thereof. The holding devices serve as an aid in threading-in the web, and permit a faster resumption of rotation after an emergency stop. The holding devices, which are of very simple construction and, therefore, relatively invulnerable to malfunction, can be provided opposite any previously existing roller in groups of cooling rollers, in the dryer, or even in the superstructure, and can also be positioned against or in engagement with an undamaged web of material without impeding the travel thereof. Positioning the holding devices 13 and 15 against or into engagement with rollers which support the webs of material 1 and 2 provides the possibility of stopping these rollers with their own deceleration, depending upon the individual moment of inertia thereof. The deflection of the bristles of the retaining element 17 at the position 17.2 thereof shown in FIG. 2 causes an inhibition or retardation in the motion of the web of material 1, 2 counter to the respective original web travel directions 28 and 29. The webs of material 1 and 2 are consequently elastically clamped against the surfaces of the rollers 5, 14, 16 facing one another under the holding devices 13 and 15.

I claim:

1. A holding device for a web of material in a rotary printing press having web material guiding rollers over which the web of material is guidable, comprising a temporarily activatable retainer having flexible retaining elements for retarding motion of the web of material counter to motion of the web in an original travel direction thereof, said retainer disposed on a side of the web opposite the web material guiding rollers and working in cooperation with the rollers.

2. The holding device according to claim 1, wherein said retainer is pivotably engageable with the web material guiding rollers.

3. The holding device according to claim 2, wherein said retaining element extends over the width of the respective rollers.

4. The holding device according to claim 2, wherein said flexible retaining elements are flexible bristles.

5. The holding device according to claim 1, wherein said retainer is a plurality of retainers each having flexible retaining elements engageable with each of the web material guiding rollers, said retaining elements being distributed over the width of the respective roller.

6. The holding device according to claim 2, wherein the web of material is formed of a plurality of individual web ribbons, and a respective retaining element is assigned to each of the ribbons of the web.

7. The holding device of claim 1, further including at least one device for selectively moving said retainer into and out of an active position.

8. The holding device according to claim 7, wherein said selective moving device is a respective adjusting cylinder for selectively disposing said retainer in and out of said active position thereof.

9. The holding device according to claim 7, wherein said selective moving device is an electromotive device.

10. The holding device according to claim 7, wherein said selective moving device is an electromotive device.

11. The holding device according to claim 1, wherein said retainer is dimensioned to be disposed in one of a turner bar section, a superstructure dryer, and a folding triangle above a folder apparatus of the web-fed rotary printing press and other difficult to reach places within the printing press.

12. In a rotary printing press having an angle-bar superstructure and web material guiding rollers over which the web of material is guidable, the improvement comprising a plurality of flexible retaining elements mounted in the angle-bar superstructure for retarding movement of webs of material or ribbons thereof counter to an original travel direction thereof, said plurality of flexible retaining elements being disposed on a side of the web opposite the web material guiding rollers and working in cooperation with the rollers.

* * * * *